US005406755A

United States Patent [19]

Serano

[11] Patent Number: 5,406,755

[45] Date of Patent: Apr. 18, 1995

[54] GUTTER PROTECTOR

[76] Inventor: Richard E. Serano, 224 E. Highland Ave., Philadelphia, Pa. 19118

[21] Appl. No.: 223,576

[22] Filed: Apr. 6, 1994

[51] Int. Cl.[6] ..... E04D 13/06

[52] U.S. Cl. ..... 52/12; 52/11; 210/474; 210/801

[58] Field of Search ..... 52/11, 12, 15; 210/474, 210/801

[56] References Cited

PUBLICATIONS

"Gutter Helmet" advertisement Berger Brothers Co. Feasterville, Pa. Jan. 30, 1984.

*Primary Examiner*—Carl D. Friedman
*Assistant Examiner*—Robert J. Canfield
*Attorney, Agent, or Firm*—Miller & Christenbury

[57] ABSTRACT

A gutter protector for preventing debris from entering a gutter while permitting flow of water into the gutter. The gutter protector has a substantially flat surface for attachment to a roof. The gutter protector also has a curved surface extending beyond the outer wall of the gutter and curving toward the gutter's interior. Ridges formed on the curved surface of the gutter protector contact the outer wall of the gutter thereby creating a space for water flow into the gutter interior between the gutter protector and the gutter outer wall.

8 Claims, 4 Drawing Sheets

GUTTER PROTECTOR

FIELD OF THE INVENTION

This invention relates to a gutter protector. In particular, this invention relates to a gutter protector which deflects debris away from gutters while permitting water to flow into the gutters.

BACKGROUND OF THE INVENTION

Traditional gutters trap and accumulate debris from trees, animals and other sources. Accumulated debris severely reduces the ability of gutters to properly transfer water from the roof of a structure to locations away from the foundation of the structure, thereby defeating the fundamental purpose of gutters. Also, debris accumulation necessitates periodic maintenance to remove the debris and return the gutters to operational condition.

Various attempts have been made to alleviate debris accumulation in gutters. Each attempt, however, has provided either expensive, impractical designs or fails to provide systems easily and securely integrated with respect to standard, existing gutters.

Each of the following patents either failed to propose a gutter protector capable of maintaining a uniform space between the protector and a standard gutter, or proposed expensive, complicated, or impractical spacing methods: U.S. Pat. Nos. 603,611 to Nye; 2,669,950 to Bartholomew; 4,404,775 to Demartini; 4,435,925 to Jefferys; 4,493,588 to Duffy; 4,497,146 to Demartini; 4,796,390 to Demartini; and 5,016,404 to Briggs. For example, the device proposed by Demartini in his '775 patent either provides no manner for maintaining a constant water flow passage between the device and gutter, or requires a separate, complicated support bracket.

The following patents failed to propose a gutter protector capable of adequately protecting the gutter from debris accumulation: U.S. Pat. Nos. 546,042 to Van Horn; 836,012 to Cassen; 891,405 to Cassens; 2,672,832 to Goetz; 4,455,791 to Elko et al; 4,604,837 to Beam; 4,757,649 to Vahldieck; and 5,181,350 to Meckstroth. For example, the device proposed by Van Horn in the '042 patent would trap debris where the shield meets the gutter, thereby preventing water flow into the gutter.

Therefore, there is a great and thus far unsatisfied demand for an inexpensive, uncomplicated, and effective gutter protector for use with standard gutters.

OBJECTS OF THE INVENTION

Accordingly, it is an object of the invention to overcome the problems associated with devices proposed in the prior art.

It is another object of the invention to provide a gutter protector capable of deflecting debris away from a gutter while directing water flow into the gutter.

It is a further object of the invention to provide a one-piece gutter protector which is simple to install and inexpensive to manufacture.

It is yet another object of the invention to provide a gutter protector for use with standard gutters.

It is another object of the invention to provide a gutter protector which maintains a constant and adequate path for water flow into the gutter.

Other objects of the invention will be apparent to one of skill in this art in view of the description that follows.

SUMMARY OF THE INVENTION

This invention provides a gutter protector which deflects debris away from the gutter while permitting water to flow into the gutter. The gutter protector has a substantially flat surface to permit attachment to the building roof and a curved surface to deflect debris over the outermost edge of the gutter.

The shape of the gutter protector maintains a constant and adequate path for water flow from the roof and into the gutter. Ridges formed on or attached to the surface of the gutter protector permit the protector to rest upon and be supported by a standard gutter and maintain a constant water flow path to the interior of the gutter without the need for separate or complicated spacing brackets.

DETAILED DESCRIPTION OF THE INVENTION

Figure 1:
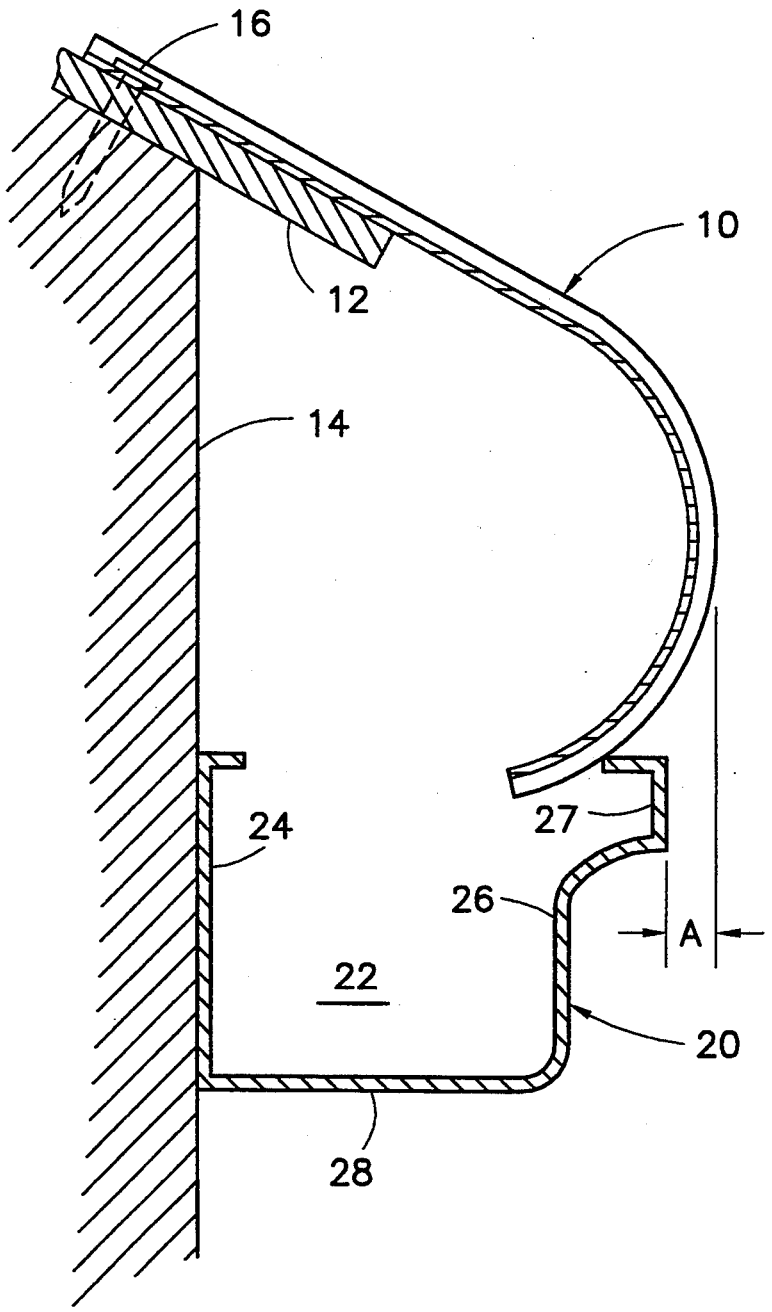
FIG. 1 is a cross-sectional side view of a gutter protector according to this invention shown mounted to a building roof with a standard gutter.

The following description is intended to refer to the specific embodiment illustrated in the drawings. This description is not intended to define or limit the scope of the invention, which is defined separately in the claims that follow.

Referring to FIG. 1, the numeral "10" designates an embodiment of the gutter protector according to this invention. Gutter protector 10 is shown mounted to a roof 12 of a building 14. Nails 16 are used to attach gutter protector 10 to roof 12. Gutter protector 10 contacts gutter 20.

Gutter 20 is a standard gutter trough commonly known and used in the commercial and residential building industry. Gutter 20 has an interior space 22 defined by an inner wall 24 adjacent building 14, an outer wall 26 having an outermost edge 27, and a bottom wall 28 connecting inner wall 24 to outer wall 26. It will be seen, however, that gutter protector 10 can be used with a gutter having almost any configuration.

Details of gutter protector 10 will be described with reference to FIGS. 2 and 3. However, FIG. 1 illustrates an important feature of the invention wherein a portion of gutter protector 10 extends beyond outermost edge 27 of outer wall 26 as shown by arrow "A". This feature eliminates possible grooves, troughs, creases or channels between gutter protector 10 and the gutter where debris can collect.

Figure 2:
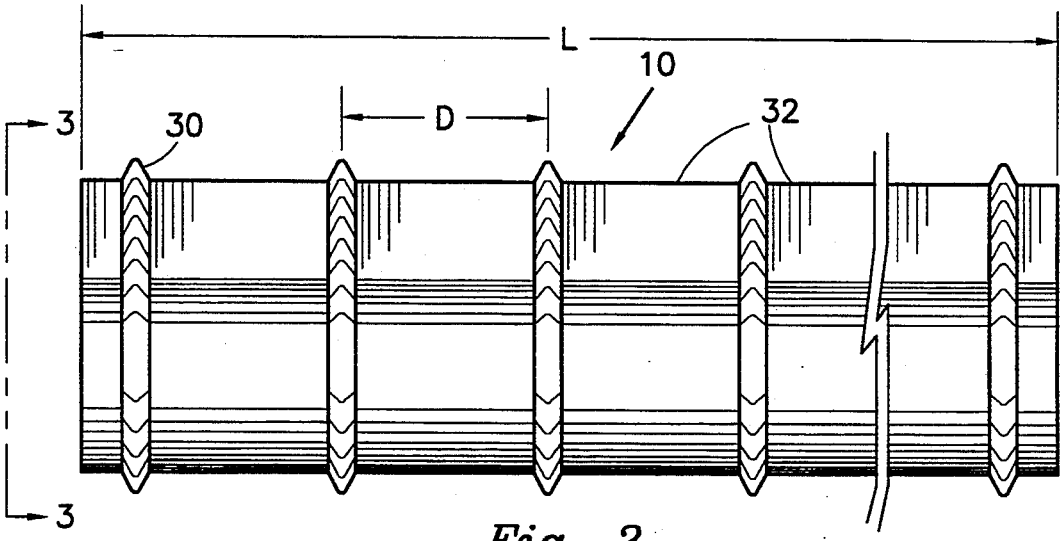
FIG. 2 is a front view of the gutter protector shown in FIG. 1.

Referring to FIG. 2, gutter protector 10 has an overall length L which preferably corresponds to the length of gutter trough above which gutter protector 10 is mounted. Gutter protector 10 has ridges 30 spaced along length L, wherein adjacent ridges 30 are separated by a distance D. Between adjacent ridges 30, gutter protector 10 has substantially smooth surfaces 32.

Figure 3:
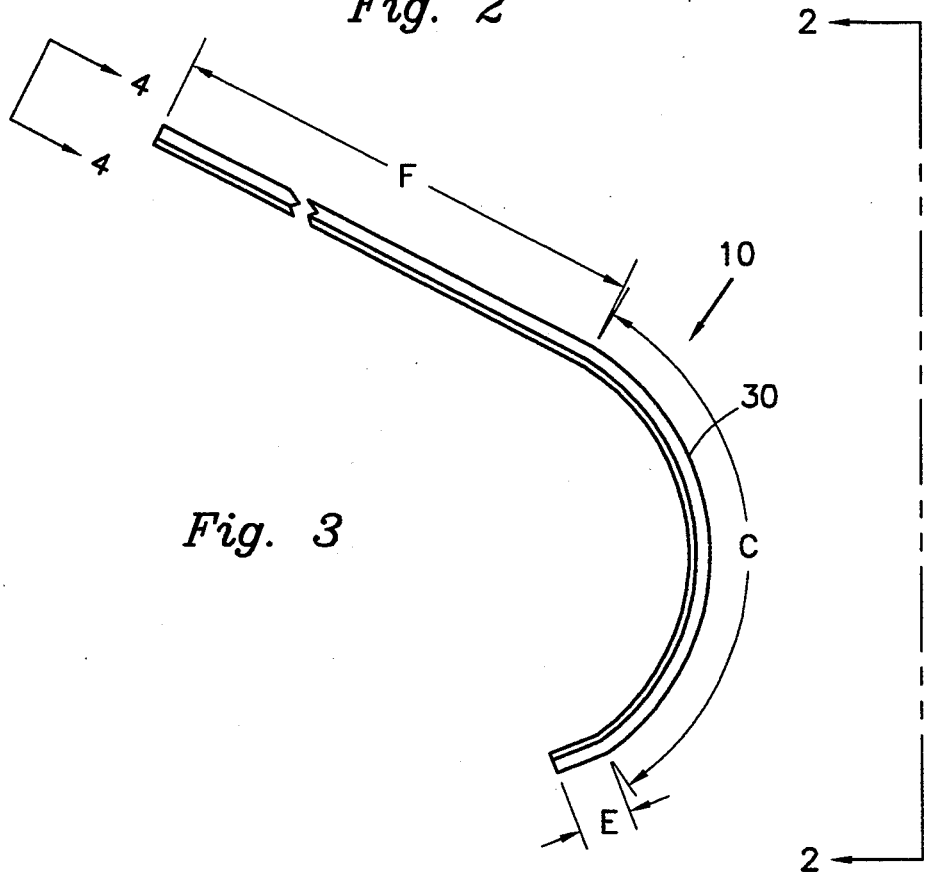
FIG. 3 is a side view of the gutter protector shown in FIGS. 1 and 2.

FIG. 3 shows gutter protector 10 from the side, illustrating important contours. Specifically, gutter protector 10 has a flat portion F. Adjacent to flat portion F is a curved portion C, and gutter protector 10 terminates with an end portion E adjacent curved portion C.

Flat portion F is provided to conform to the roof of a building such as roof 12 of building 14 (FIG. 1). Flat portion F facilitates rigid mounting to roof 12 and firm support of gutter protector 10.

The curvature of curved portion C is gentle enough so that water flowing along flat portion F of gutter protector 10 will adhere to and follow the contour of curved portion C by operation of surface tension between the water and gutter protector 10. If the curvature of curved portion C is too sharp, water from fiat portion F will separate from curved portion C due to causation of water movement force in excess of the holding force of surface tension. This condition is undesirable because water would then escape outer wall 26 of gutter 20 (FIG. 1).

Gutter protector 10 terminates at end portion E which extends into interior 22 of gutter 20. End portion E is optionally flat or continues the curvature of curved portion C.

Figure 4:
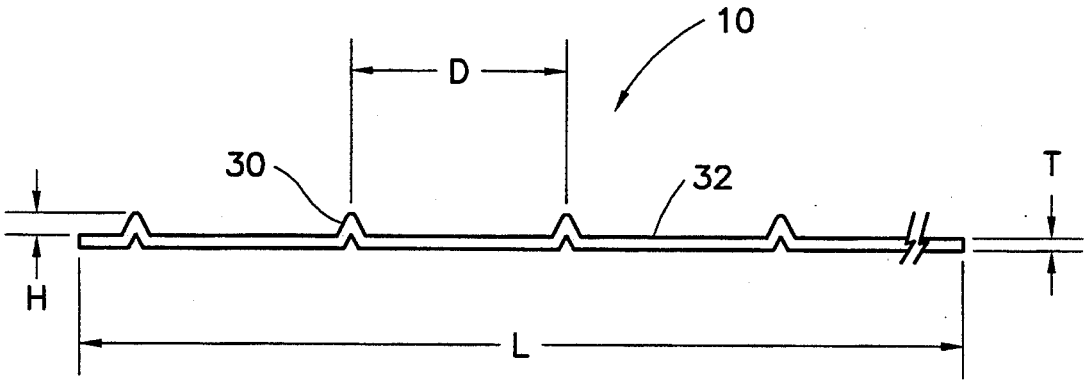
FIG. 4 is an end view of the gutter protector shown in FIGS. 1–3 illustrating details of a sheet that forms the gutter protector.

Referring to FIG. 4, gutter protector 10 has a thickness T sufficient to provide a rigid surface capable of withstanding environmental elements such as wind, ice and snow. However, thickness T must also permit deformation of the gutter protector 10 so that curved portion C may be formed. Thickness T of gutter protector 10 must also permit minor bending so that adjustments can be made to fit existing roof/gutter combinations.

Gutter protector 10 is preferably formed from malleable materials such as aluminum, copper, stainless steel, alloys or other metallic materials commonly used in building gutter systems. However, gutter protector 10 is optionally formed from plastic, fiberglass, composite material or other suitable ultraviolet resistant materials, depending upon the manufacturer's preference.

Ridges 30 on gutter protector 10 are provided with a height H shown in FIG. 4. Height H of ridges 30 must be sufficient to separate smooth surfaces 32 from outer wall 26 of gutter 20 upon which gutter protector 10 rests as shown in FIG. 1. This separation must be sufficient to permit water flow from roof 12, across fiat portion F, around curved portion C, past end portion E, and into interior 22 of gutter 20. Accordingly, ridges 30 with height H provide important spacing between gutter protector 10 and gutter 20 without the need of additional support components or complicated contours.

Ridges 30 in gutter protector 10 are optionally provided with notches at or near the point where gutter protector 10 rests against outer wall 26 of gutter 20. The optional notches help position gutter protector 10 against gutter 20 during installation to ensure proper operation of gutter protector 10. Specifically, the optional notches assist to align gutter protector 10 with gutter 20 so that curved portion C of gutter protector 10 extends an optimal distance beyond outer wall 26 of gutter 20. The notches also help to maintain this optimal position during operation of gutter protector 10.

Optional notches in ridges 30 can have any shape. The notches can have sharp angles, curves or tapers which reduce height H of ridges 30 where gutter protector 10 contacts gutter 20. Also, each optional notch in each ridge 30 can extend through end portion E of gutter protector 10. For example, forming a notch that reduces height H of ridge 30 from one inch to one-half inch at the optimal point of contact between gutter protector 10 and gutter 20 assists during installation and operation to ensure that gutter protector 10 is properly positioned.

Of course, such a notch can have any shape or dimension or can be omitted entirely, depending upon the manufacturer's preference. Similarly, such a notch can be formed in any manner, including but not limited to cutting, molding, bending or any other forming method appropriate for the specific gutter protector material selected.

Notches are also optionally provided at other locations along ridges 30 to assist in manufacturing of gutter protector 10. For example, notches positioned on ridges 30 along curved portion C of gutter protector 10 would assist during formation of curved portion C. This is especially true when gutter protector 10 is formed from metallic sheet bent to form curved portion C.

Installation and operation of gutter protector 10 will now be described with reference to FIGS. 1–4. Gutter protector 10 is attached to roof 12 of building 14 by means of a series of nails 16 through flat portion F. Of course, other attaching means may be employed alone or in combination such as screws, tacks, adhesives, roofing tar and the like. Gutter protector 10 can optionally be installed so that roofing shingles (not shown) either pass underneath or rest on top of a portion of flat portion F.

The position and shape of gutter protector 10 is adjusted so that either end portion E or curved portion C rests against outer wall 26 of gutter 20. Accordingly, gutter protector 10 is firmly supported against roof 12 and gutter 20. Ridges 30 on gutter protector 10 rest upon outer wall 26 of gutter 20, and the space between smooth portions 32 of gutter protector 10 and outer wall 26 of gutter 20 form a path through which water easily flows into gutter interior 22.

Figure 5:
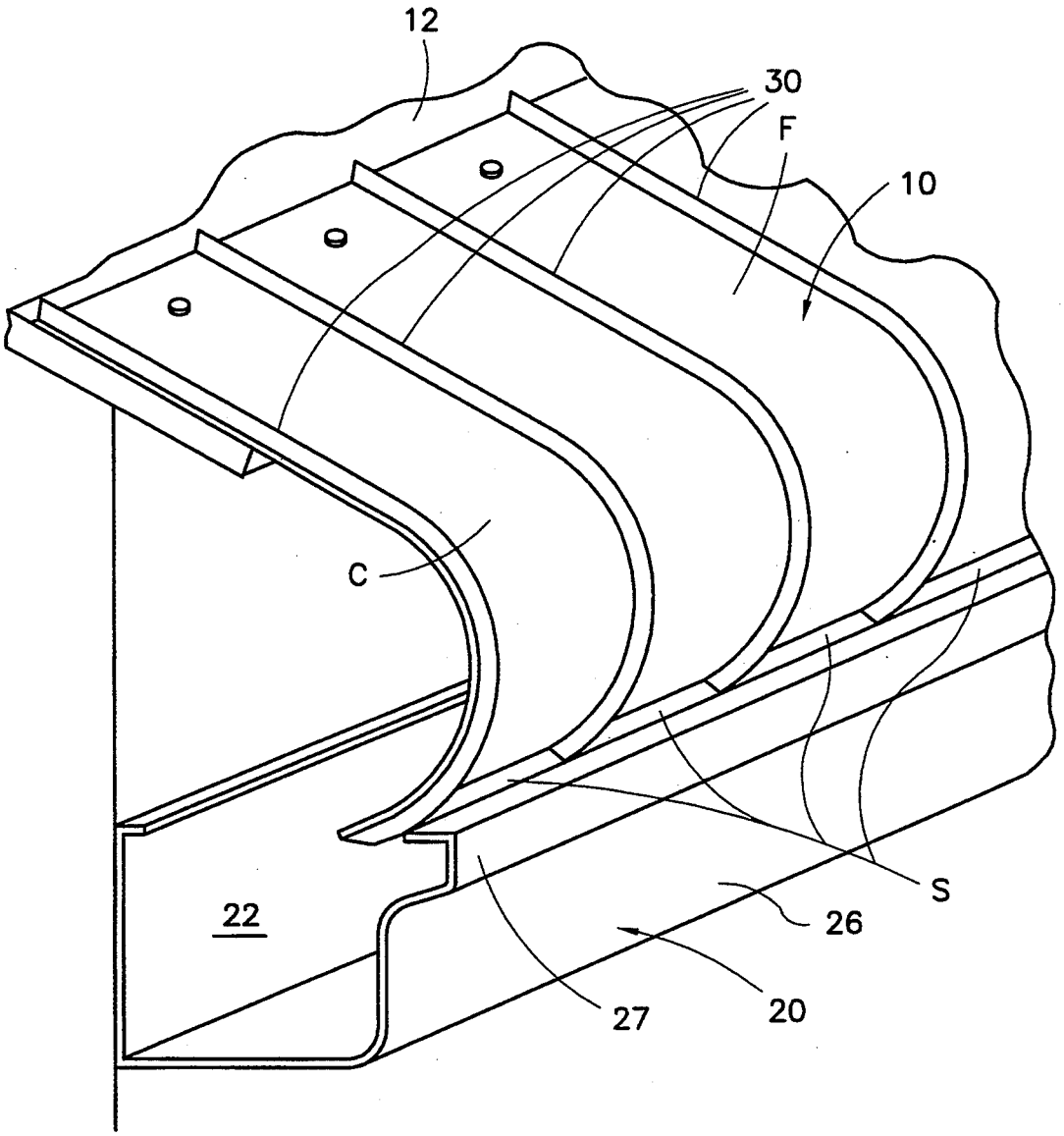
FIG. 5 is a perspective view of a gutter protector according to this invention shown mounted to a building roof with a standard gutter.

Operation of gutter protector 10 is described with reference to FIG. 5. Debris on roof 12 from overhanging trees or other sources is swept by rainwater over flat portion F and curved portion C of gutter protector 10. The debris then falls from gutter protector 10 over the outer most edge of the gutter depicted as outermost edge 27 of outer wall 26 of gutter 20. Accordingly, debris neither collects within gutter interior 22 nor prevents passage of water into gutter interior 22. Water flow from roof 12 flows across flat portion F of gutter protector 10 and around curved portion C, adhering to curved portion C by means of surface tension. Water flow passes through the constant spaces S maintained by ridges 30 between gutter protector 10 and outer wall 26 of gutter 20. Accordingly, water flow is deposited within interior 22 of gutter 20. End caps (not shown) may be applied to each end of gutter protector 10 to prevent ingress of debris into the gutter.

The following Example exemplifies the operation of a gutter protector according to this invention.

EXAMPLE

A gutter protector according to this invention was formed from aluminum flashing having thickness T of approximately 1/64-inches and length L of approximately 10 inches. Ridges were formed transverse to the gutter protector's length separated by distance D of approximately $3\frac{1}{2}$-inches. The ridges were formed with height H of approximately $\frac{1}{2}$-inch.

Flat portion F had an approximate length of 8 inches, and curved portion C had a radius of approximately ¾-inch. End portion E was a continuation of the curvature of curved portion C.

The gutter protector was attached to a roof surface, and tap water from a hose was supplied to the roof at progressively greater flow rates. Specifically, tap water was supplied to the roof at flow rates of 30 gallons per hour, 45 gallons per hour, 60 gallons per hour, 90 gallons per hour, and 120 gallons per hour. These flow rates represent the flow of water over each one-foot length of the gutter protector.

Even at the highest flow rate of 120 gallons per hour per foot of gutter protector, simulated rainwater followed the contour of curved portion C. This indicates that rainwater, even during severe rainstorms, will follow the contour of the gutter protector and flow into a gutter while debris is deflected over the gutter.

If desired, changes and modifications can be made to the illustrated embodiment of this invention without departing from its spirit and scope. For example, gutter protector 10 may be formed from standard corrugated material, and the ridges or corrugations need not run transverse to the gutter protector length. In fact, it is contemplated that the corrugations may run at any angle to the gutter protector length. Moreover, ridges 30 may be attached to smooth surfaces 32 of protector 10 instead of being formed from the sheet that contains smooth surfaces 32. These attached ridges 30 may be connected by any means known in the art and may be made from the same or different material.

The gutter protector can be manufactured with varied dimensions of thickness, ridge height, and ridge separation, so long as a space is provided for water flow into the gutter. However, the number and spacing of the ridges should not impede formation of a thin "sheetlike" flow of water over smooth surfaces 32. Otherwise, a channeling effect will develop that may overcome the surface tension driven adherence to curved portion C, thereby causing the water to flow beyond outermost edge 27 of gutter 20. Furthermore, the radius of gutter protector curvature need only be large enough to assure that surface tension is capable of holding water flow against the gutter protector. Finally, the overall contour of the gutter protector can be modified so long as a portion of the protector extends beyond outer wall 26 of the gutter.

The present invention, in any embodiment, provides an inexpensive device for reliably preventing debris accumulation in standard gutters. The invention is inexpensive to manufacture, easy to install, and dependable in use because of its unique one-piece construction and adaptability to standard gutter systems.

What is claimed is:

1. A combined gutter and gutter protector, said gutter protector being shaped to prevent debris from a roof of a building from entering said gutter and to permit flow of water from said roof of said building into said gutter, said gutter having an interior defined by an inner wall, an outer wall, and a bottom wall connecting said inner wall to said outer wall, said gutter protector comprising:

a mounting surface along the length of said gutter protector adapted for attachment to said roof of said building;

a curved surface along said length of said gutter protector, said curved surface extending from said mounting surface, beyond said outer wall of said gutter, and curving toward said interior of said gutter;

and ridges projecting from said curved surface of said gutter protector, said ridges being at an angle to said length of said gutter protector, and said ridges being capable of contacting said outer wall of said gutter to provide support for said gutter protector and define a space for said water flow from said gutter protector into said interior of said gutter.

2. A gutter protector for use with a structure having a gutter with a water receiving opening, said gutter protector comprising:

a longitudinally extending mounting surface adapted for attachment to said structure;

a curved surface portion extending from said mounting surface and adapted to extend beyond an outer wall of said gutter and curve toward said opening when said mounting surface is attached to said structure; and ridges projecting outwardly from at least a portion of said curved surface portion, said ridges being located substantially transverse to the length of said gutter protector and adapted to be capable of contacting said outer wail of said gutter and define a space for water flow from said curved surface portion into said gutter when said mounting surface is attached to said structure:

3. The gutter protector described in claim 2, further comprising an end portion extending from said curved surface portion and adapted to extend into said water receiving opening in said gutter when said mounting surface is attached to said structure.

4. The gutter protector described in claim 3, wherein said ridges project outwardly from at least a portion of said end portion of said gutter protector, and said ridges on at least one of said curved surface portion and said end portion are adapted to contact said outer wall of said gutter to provide support for said gutter protector when said mounting surface is attached to said structure.

5. The gutter protector described in claim 2, wherein adjacent ones of said ridges are spaced a distance to allow sheet-like flow of water over said curved surface portion with adherence between water and said curved surface portion by surface tension.

6. The gutter protector described in claim 2, wherein said longitudinally extending mounting surface is substantially flat.

7. The gutter protector described in claim 6, wherein said longitudinally extending mounting surface is adapted for attachment to a roof of said structure beneath shingles attached to said roof.

8. A gutter protector comprising:

a longitudinally extending mounting surface adapted for attachment to a roof of a structure having a gutter with a water receiving opening;

a curved surface portion extending from said mounting surface and adapted to extend beyond an outer wall of said gutter and curve toward said opening; and ridges projecting outwardly from at least a portion of said curved surface portion, said ridges being located substantially transverse to the length of said gutter protector and adapted to be capable of contacting said outer wall of said gutter and define a space for water flow from said curved surface portion into said gutter, said ridges being formed from elongated members attached to said curved surface portion of said gutter protector.

* * * * *